US010845163B2

(12) United States Patent
Nardone

(10) Patent No.: US 10,845,163 B2
(45) Date of Patent: Nov. 24, 2020

(54) BALLISTIC VEST

(71) Applicant: PriveCo Inc., Troy, MI (US)

(72) Inventor: Thomas Michael Nardone, Birmingham, MI (US)

(73) Assignee: PriveCo Inc., Troy, MI (US)

( * ) Notice: Subject to any disclaimer, the term of this patent is extended or adjusted under 35 U.S.C. 154(b) by 287 days.

(21) Appl. No.: 15/983,763

(22) Filed: May 18, 2018

(65) Prior Publication Data

US 2019/0353464 A1 Nov. 21, 2019

(51) Int. Cl.
*F41H 5/04* (2006.01)
*A41D 1/04* (2006.01)
*A41D 31/24* (2019.01)

(52) U.S. Cl.
CPC ..... *F41H 5/0478* (2013.01); *A41D 1/04* (2013.01); *A41D 31/24* (2019.02)

(58) Field of Classification Search
CPC ..... F41H 1/02; F41H 5/0478; F41H 5/0492; A41D 1/04; A41D 31/24
USPC ..... 2/2.5
See application file for complete search history.

(56) References Cited

U.S. PATENT DOCUMENTS 4,413,357 A * 11/1983 Sacks ..... F41H 1/02 2/2.5
5,331,683 A * 7/1994 Stone ..... F41H 1/02 2/102
5,974,585 A * 11/1999 Bachner, Jr. ..... F41H 1/02 2/2.5
7,424,748 B1 * 9/2008 McDunn ..... F41H 5/013 2/2.5
8,826,462 B2 * 9/2014 Storms, Jr. ..... F41H 1/02 2/2.5
9,144,255 B1 * 9/2015 Perciballi ..... A41D 27/00
9,222,757 B2 * 12/2015 Seuk ..... F41H 1/02
2006/0143763 A1 * 7/2006 Dawson ..... F41H 1/02 2/2.5
2010/0162459 A1 7/2010 Bronstein et al.
2012/0132065 A1 * 5/2012 Seuk ..... F41H 1/02 89/36.05
2012/0174276 A1 * 7/2012 Craffey ..... F41H 1/02 2/2.5
2012/0174300 A1 * 7/2012 Weber ..... F41H 5/0478 2/463
2012/0216324 A1 * 8/2012 Medwell ..... F41H 1/02 2/2.5
2012/0240300 A1 * 9/2012 Pittman ..... F41H 13/0025 2/2.5
2013/0081195 A1 * 4/2013 Faridoon ..... A41D 1/04 2/102
2013/0133130 A1 * 5/2013 Crye ..... F41H 1/02 2/463

(Continued)

*Primary Examiner* — Anne M Kozak
(74) *Attorney, Agent, or Firm* — Smartpat PLC

(57) ABSTRACT

A ballistic vest carrier is formed by two overlapping outer panels and two overlapping inner panels. The ballistic vest carrier is configured to hold a soft ballistic panel and provides a pocket for an optional hard ballistic plate. The pocket for the optional ballistic plate is accessible from the outside face through an outer access opening. The outer face of the ballistic vest carrier is free of protruding edges, allowing concealed use of the ballistic vest carrier. A ballistic vest includes two ballistic vest carriers which are connected by shoulder straps and side straps.

16 Claims, 4 Drawing Sheets

(56) References Cited

U.S. PATENT DOCUMENTS

| | | | | |
|---|---|---|---|---|
| 2013/0152290 | A1* | 6/2013 | Chou | F41H 1/02 2/463 |
| 2014/0259251 | A1* | 9/2014 | Moore | F41H 1/02 2/2.5 |

* cited by examiner

BALLISTIC VEST

TECHNICAL FIELD

The present invention generally relates to a ballistic vest, and more particularly, to a soft ballistic vest having concealed pockets for optional hard ballistic plates.

BACKGROUND

A ballistic vest or bullet-resistant vest, often called a bulletproof vest, is an item of personal armor worn on the torso that helps absorb the impact and reduce or stop penetration to the body from firearm-fired projectiles. Soft vests are made of many layers of woven or laminated fibers and can protect the wearer from small-caliber handgun and shotgun projectiles. These vests often have a ballistic plate inserted into the vest. Metal or ceramic plates can be used with a soft vest, providing additional protection against rifle rounds.

Soft vests are commonly worn by police forces, security guards, bodyguards, and private citizens. Hard-plate reinforced vests are mainly worn by combat soldiers, police tactical units, and hostage rescue teams but are becoming increasingly popular also among civilian users.

Some users desire to conceal wearing a ballistic vest under garment such as a shirt, a T-shirt, a sweater, or the like. While some soft vests have been designed with concealed use in mind, hard-plate reinforced vests have traditionally been difficult or impossible to conceal due to protruding edges on an outer face of the vest. For example, hard-plate reinforced vest may include an exterior pocket that is sized to accommodate the hard plate and that protrudes an outer face of the vest by 2 cm or more. Such protrusion show through any shirt or T-shirt and make it impossible to conceal the ballistic vest, even if the hard plate is not inserted.

SUMMARY

The disclosed ballistic vest addresses the shortcomings of the prior art. It has an internal pocket for a ballistic plate, while having an outer face without protruding edges that can be more easily concealed than known vests. The internal pocket is accessible from the outside while the vest is worn, allowing a user to quickly insert a ballistic plate without having to remove the vest. The disclosed vest can be produced with less labor and thus more cost competitively than comparable vests.

A ballistic vest carrier for an improved ballistic vest includes an upper outer carrier panel and a lower outer carrier panel which jointly form an outer face of the ballistic vest carrier. An upper inner carrier panel and a lower inner carrier panel jointly form an inner face of the ballistic vest carrier. The outer face and the inner face of the ballistic vest carrier are congruent and connected to each other by a circumferential seam extending along an outer edge of the ballistic vest carrier. An inner access opening is formed at an overlap of the upper inner carrier panel and the lower inner carrier panel through which a soft ballistic panel can be inserted into the ballistic vest carrier. An outer access opening is formed at an overlap of the upper outer carrier panel and the lower outer carrier panel through which a hard ballistic plate can be inserted into a pocket formed inside the ballistic vest carrier.

The pocket for the hard ballistic plate inside the ballistic vest carrier is at least partially formed by a portion of the upper outer carrier panel which extends below the overlap with the lower outer carrier panel.

Preferably, the lower inner carrier panel and the upper inner carrier panel overlap along a generally horizontal area and the lower inner carrier panel has a height between 5 cm and 20 cm. The lower outer carrier panel may have a height between 35 cm and 40 cm.

To allow concealed use of the ballistic vest, the outer face of the ballistic vest carrier is free of protruding edges. The upper outer carrier panel and the lower outer carrier panel may be made of woven nylon. The ballistic vest carrier is preferably configured to accept a ballistic panel having a width between 41 cm and 48.5 cm and a height between 40 cm and 43.5 cm. The pocket is configured to accept a ballistic plate having a width between 25 and 30 cm and a height between 25 and 35 cm.

A ballistic vest is formed by two ballistic vest carriers which are held together by shoulder straps and side straps. An improved ballistic vest thus includes a front carrier and a rear carrier. Shoulder straps connect an upper portion of the front carrier with an upper portion of the rear carrier. Side straps connect left and right side portions of the front carrier with respective left and right side portion of the rear carrier. The front carrier and the rear carrier each have an outer face and an inner face made of fabric panels connected by a seam along an outer perimeter of the carrier. The outer face is formed by a lower outer carrier panel and an overlapping upper outer carrier panel. The inner face is formed by a lower inner carrier panel and an overlapping upper inner carrier panel. A ballistic panel is held within the carrier between the outer face and the inner face. The ballistic vest also includes a pocket adapted to accept a ballistic plate. The pocket is arranged on a strike side of the ballistic panel and is accessible through the overlap of the lower and upper outer carrier panels.

A hook and loop fastener may be provided to releasably connect the lower outer carrier panel and the upper outer carrier panel along a center portion of their overlap. The lower outer carrier panel and the upper outer carrier panel may be sewn together along peripheral portions of their overlap. An upper portion of the lower outer carrier panel may have a generally trapezoidal shape in an area of the hook and loop fastener.

When sewn together the seam along the outer perimeter of the carrier connects the lower inner carrier panel to the lower outer carrier panel, the upper inner carrier panel to the lower outer carrier panel, and the upper inner carrier panel to the upper outer carrier panel.

The ballistic plate pocket is at least partially formed by a portion of the upper outer carrier panel which is arranged on an inside of the lower outer carrier panel below an upper edge of the lower outer carrier panel. A portion of the upper outer carrier panel which is arranged below an upper edge of the lower outer carrier panel may so form an inner wall of the pocket.

The following detailed description of the invention is merely exemplary in nature and is not intended to limit the invention or the application and uses of the invention. Furthermore, there is no intention to be bound by any theory presented in the preceding background of the invention or the following detailed description of the invention.

DETAILED DESCRIPTION

Figure 1:
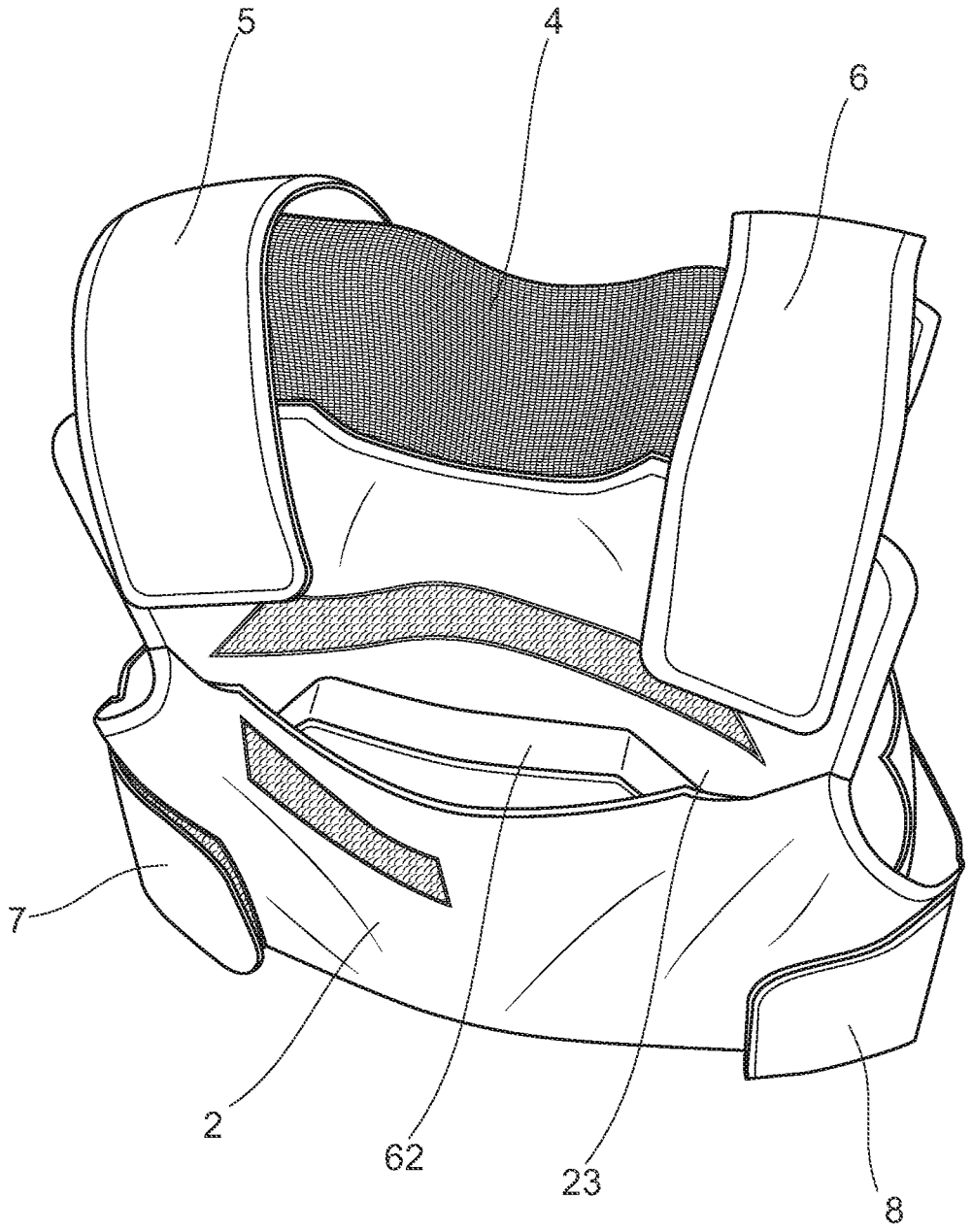
FIG. 1 is perspective front and top view of a ballistic vest.
Figure 4:
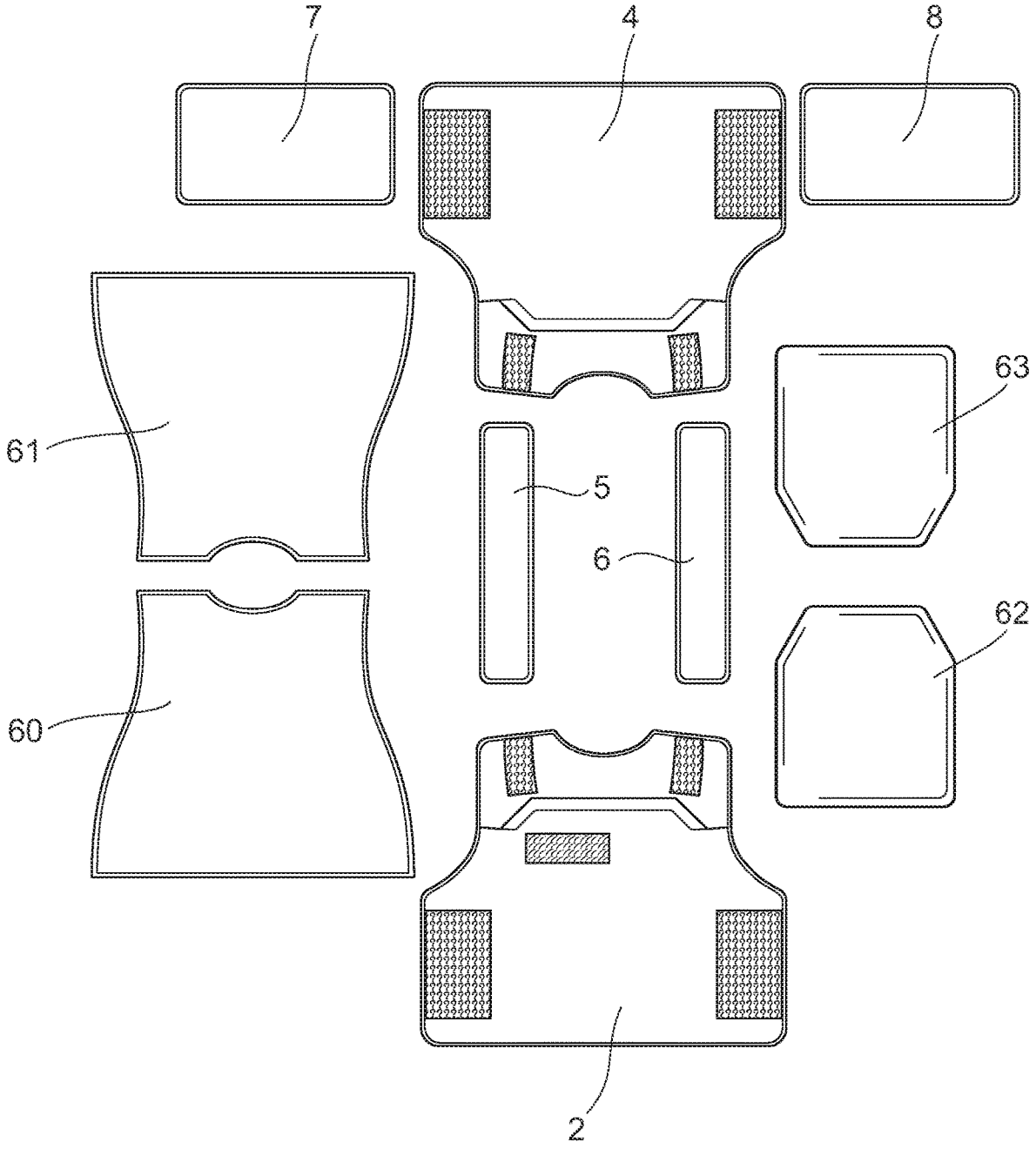
FIG. 4 is a laid out exploded view of components forming the ballistic vest as in FIG. 1.

Referring to FIG. 1, a ballistic vest 1 is shown in a perspective front and top view. The different components forming the ballistic vest 1 are shown laid out separately in FIG. 4. The ballistic vest 1 includes a front ballistic vest carrier 2 and a rear ballistic vest carrier 4. The front ballistic vest carrier 2 and the rear ballistic vest carrier 4 may be of the same shape and size. The front ballistic vest carrier 2 and the rear ballistic vest carrier 4 are held together by shoulder straps 5, 6 and side straps 7, 8. In this specification the terms "ballistic vest carrier", "vest carrier", or simply "carrier" may refer to either the front ballistic vest carrier 2 or the rear ballistic vest carrier 4. The plural "ballistic vest carriers", "vest carriers", or simply "carriers" will refer collectively to the front ballistic vest carrier 2 and the rear ballistic vest carrier 4.

Arranged within the front ballistic vest carrier 2 is a front ballistic panel 60 which may be a soft ballistic panel made e.g. of high-strength polyethylene or Kevlar®. Arranged within the rear ballistic vest carrier 4 is a rear ballistic panel 61 which may be identical to the front ballistic panel 60. An interior pocket 23 may be provided within the front ballistic vest carrier 2 to insert an optional front ballistic plate 62. An equivalent interior pocket may be provided within the rear ballistic vest carrier 4 to insert an optional rear ballistic plate 63.

Figure 2:
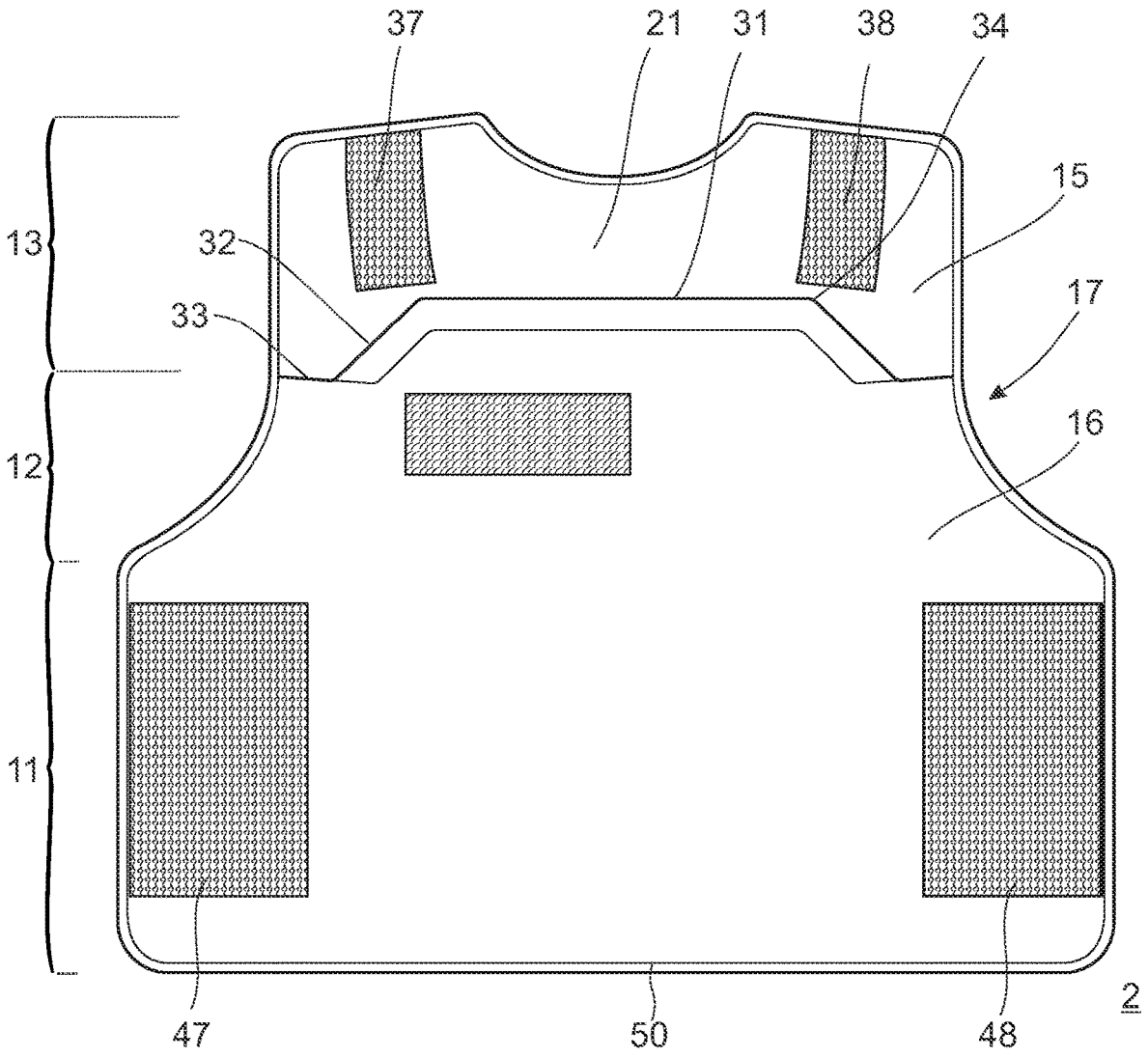
FIG. 2 is a front view of a ballistic vest carrier used in the vest shown in FIG. 1.
Figure 3:
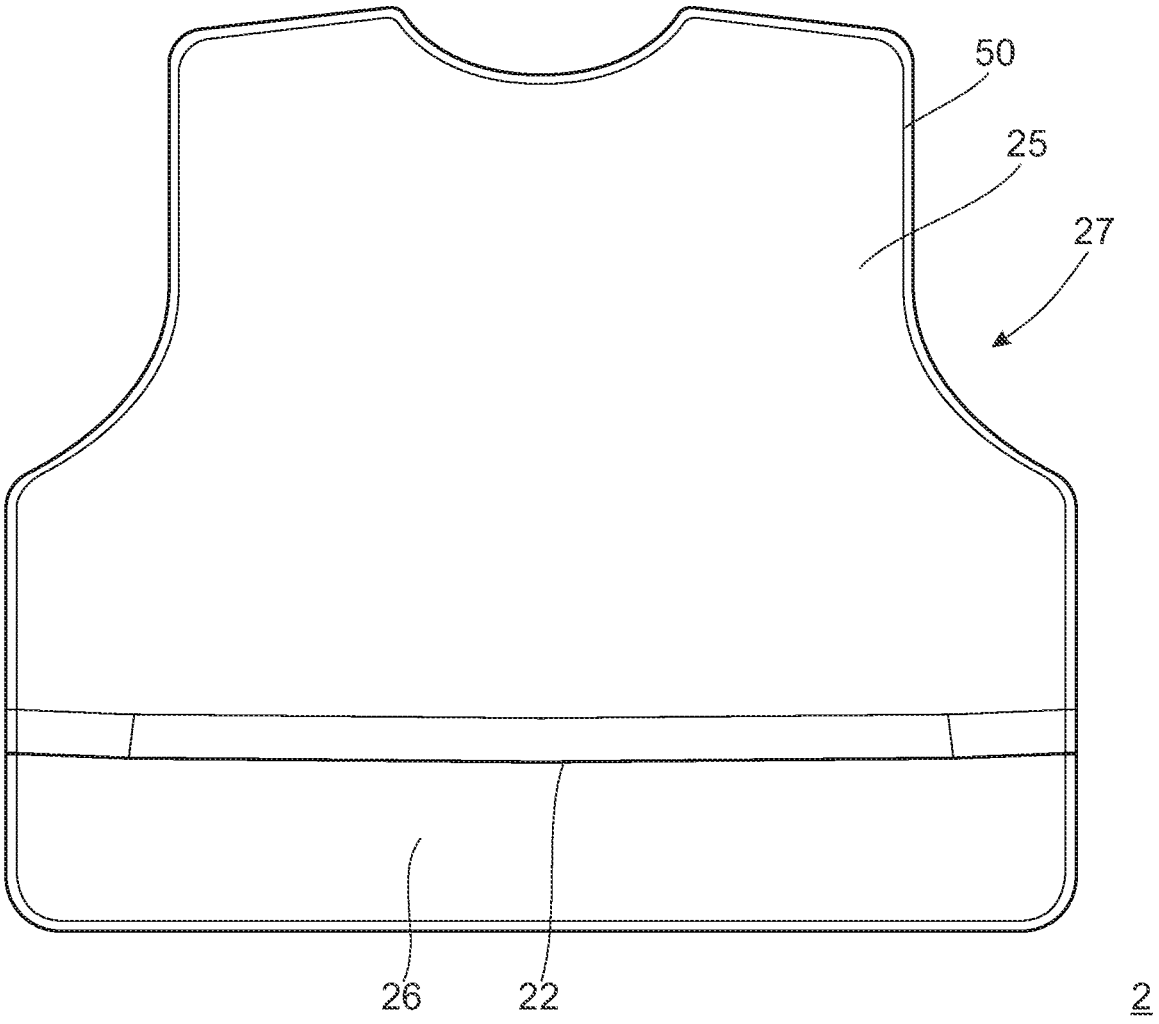
FIG. 3 is a rear view of the ballistic vest carrier shown in FIG. 2.

As shown in FIG. 2 and FIG. 3, the ballistic vest carriers 2, 4 are shaped to fit a human torso. A lower portion 11 of each carrier 2, 4 has a generally rectangular shape when laid flat and wraps around a user to cover an area of the torso from about the waist up to about the lower ribcage. Each of the carriers 2, 4 reaches circumferentially around about one half of the wearer's body. The lower portion 11 of the carrier 2, 4 extends upwardly from a lower edge of the carrier and includes approximately a lower 50% of the carrier's height.

An upper portion 13 of the carrier is also generally rectangular except for a circular segment cut out along an upper edge of the carrier to accommodate the user's neck. When in use, the upper portion 13 of the carrier 2, 4 covers an area from the wearer's shoulders reaching down to about the wearer's armpits. The upper portion 13 of the carrier 2, 4 includes approximately 25% of the carrier's height.

The lower portion 11 of the carrier is wider than the upper portion 13 thereof. For example, the lower portion 11 may be between 1.3 and 1.5 times wider than the upper portion 13.

A transitional portion 12 of the carrier 2, 4 is arranged between the lower portion 11 and the upper portion 13, accounting for the remaining approximately 25% the carrier's height. Left and right outer edges of the carrier 2, 4 in the area of the transitional portion 12 have an arcuate shape to transition from the wider lower portion 11 to the narrower upper portion 13 of the carrier.

Two shoulder strap attachment patches 37, 38 are provided on the left and right side of the upper portion 13 of the carrier to attach shoulder straps 5, 6 with hook and loop style fasteners. When in use, the shoulder straps 5, 6 connect the upper portion 13 of the front carrier 2 with the upper portion 11 of the rear carrier 4.

Two side strap attachment patches 47, 48 are provided on the left and right side of the lower portion 11 of the carrier to attach side straps 7, 8 with hook and loop style fasteners. When in use, the side straps 7, 8 connect the lower portion11 of the front carrier 2 with the lower portion 11 of the rear carrier 4.

The ballistic vest carrier 2, 4 may be made of panels of woven nylon. More specifically, the ballistic vest carrier 2, 4 may be made of an upper outer carrier panel 15 and a lower outer carrier panel 16 jointly forming an outer face 17 of the ballistic vest carrier 2, 4. An upper inner carrier panel 25 and a lower inner carrier panel 26 jointly form an inner face 27 of the ballistic vest carrier 2, 4. The outer face 17 and the inner face 27 are congruent, having the same shape and size. The panels forming the outer face 17 and the inner face 27 of the ballistic vest carrier 2, 4 are sewn together by a circumferential seam 50 along an outer edge of the outer face 17 and inner face 27.

The circumferential seam 50 connects the upper outer carrier panel 15 to the upper inner carrier panel 25. It further connects the lower outer carrier panel 16 to both the upper inner carrier panel 25 and the lower inner carrier panel 26. The lower inner carrier panel 26 is not directly connected to the upper outer carrier panel 15.

An inner access opening 22 is formed at an overlap of the upper inner carrier panel 25 and the lower inner carrier panel 26. The inner access opening 22 may be releasably closed with hook and loop fasteners provided on the overlapping portions of the upper inner carrier panel 25 and the lower inner carrier panel 26. A ballistic panel 60, 61 can be inserted into the carrier 2, 4 through the opening 22.

The shape of the ballistic panel 60, 61 may generally match the shape of and be just slightly smaller than the carrier 2, 4. The ballistic panel 60, 61 thus fits snug in the carrier 2, 4 between the front face 17 and rear face 27 thereof. The ballistic vest carrier 2, 4 may in particular be configured to accept a ballistic panel 60, 61 having a width between 41 cm and 48.5 cm and a height between 40 cm and 43.5 cm.

The inner access opening 22 is preferably provided at the lower, wider, portion 11 of the carrier and is preferably provided between 5 cm and 15 cm from the bottom edge of the carrier. Consequently, the lower inner carrier panel 26 has a height of only 5 to 15 cm. The inner access opening 22 is arranged within the lower 20% of the carrier's height. At the inner access opening 22, the upper inner carrier panel 25 may overlap the lower inner carrier panel 26 along a generally horizontal overlap area with a height of approximately 1 to 3 cm.

Even more preferably, the inner access opening 22 may be formed in a central overlap portion of the upper inner carrier panel 25 with the lower inner carrier panel 26. A hook and loop fastener may be provided to releasably connect the lower inner carrier panel 26 and the upper inner carrier panel 25 along the opening 22. Peripheral portions of the overlapping lower inner carrier panel 26 and the upper inner carrier panel 25 may extend to the left and right of the inner access opening 22 and may be sewn together between the inner access opening 22 and the outer perimeter of the carrier 2, 4.

An outer access opening 21 may be formed at an upper edge of the lower outer carrier panel 16. An interior pocket 23 which can hold a ballistic plate 62, 63 may be accessible through the outer access opening 21. Beneficially, the outer access opening 21 and through it the interior pocket 23 are accessible while the vest 1 is in use, allowing quick insertion of a ballistic plate 62, 63 when environmental conditions so require. This is particularly beneficial in times of imminent ballistic threat during which removing the vest to insert optional ballistic plates would expose the wearer to additional risk of injury.

The interior pocket may be configured to accept a ballistic plate having a width of about 27 cm and a height of about 30 cm. "About" here refers to being within ±15% of the stated dimensions. An elastic band may be provided within the interior pocket 23 to secure the ballistic plate 62, 63 therein. The pocket 23 is arranged outwardly of, i.e. on a strike side of, the soft ballistic panel 60, 61.

At least a part of the interior pocket 23 may be formed by a portion of the upper outer carrier panel 15 which extends downwardly from the upper edge of the lower outer carrier panel 16. Even more specifically, a rear wall of the interior pocket 23 may be formed by a portion of the upper outer carrier panel 15 which is overlapped by the lower outer carrier panel 16. A separate front wall panel may be sewn to the rear wall of the interior pocket 23 along a bottom edge and side edges of the interior pocket 23. A lower edge of the interior pocket 23 is preferably arranged just above the lower edge of the vest carrier, e.g. within 5 cm of the lower edge of the vest carrier.

The outer access opening 21 is preferably arranged in the upper portion 13 of the outer face 17. Consequently, the lower outer panel 15 may have a height between 35 and 40 cm.

The outer face 17 of the carrier vest is free of protruding edges. In the context of this specification "free of protruding edges" does not exclude presence of generally unnoticeable protrusions caused by the material thickness of an overlapping carrier panel and material thickness of two associated strips of hook and loop fasteners. Such protruding edges, which may have a height of 5 mm or less, are considered negligible and fall within the definition of being free of protruding edges.

The outer access opening 21 may have a generally trapezoidal shape. A central upper edge 31 of the lower outer carrier 16 may extend downwardly on the left side and right side towards outer upper edges 33. The central upper edge 31 and the downward edges 32 of the lower outer carrier 16 may overlap and be releasably secured to the upper outer carrier 15 with hook and loop fasteners. The trapezoidal shape of the outer access opening 21 provides corners 34 on either side of the central upper edge 31 which are easy to grip and support the opening of the underlying hook and loop fastener. The outer, peripheral extensions 33 of the upper edge of the lower outer carrier panel 16 may be sewn to the underlying upper outer carrier panel 15, the seam extending from the outer access opening 21 outwardly towards the left and right edge of the carrier.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A ballistic vest carrier, comprising:

an upper outer carrier panel and a lower outer carrier panel jointly forming an outer face of the ballistic vest carrier; and an upper inner carrier panel and a lower inner carrier panel jointly forming an inner face of the ballistic vest carrier, wherein the outer face and the inner face of the ballistic vest carrier are congruent and connected to each other by a circumferential seam extending along an entire outer edge of the ballistic vest carrier, and wherein an inner access opening is formed at an overlap of the upper inner carrier panel and the lower inner carrier panel for inserting a ballistic panel into the ballistic vest carrier and wherein an outer access opening is formed at an overlap of the upper outer carrier panel and the lower outer carrier panel for inserting a ballistic plate into a pocket formed in the ballistic vest carrier.

2. The ballistic vest carrier as in claim 1, wherein the pocket in the ballistic vest carrier is at least partially formed by a portion of the upper outer carrier panel which extends below the overlap with the lower outer carrier panel.

3. The ballistic vest carrier as in claim 1, wherein the lower inner carrier panel and the upper inner carrier panel overlap along a horizontal area and wherein the lower inner carrier panel has a height between 5 cm and 20 cm.

4. The ballistic vest carrier as in claim 1, wherein the lower outer carrier panel has a height between 35 cm and 40 cm.

5. The ballistic vest carrier as in claim 1, wherein the outer face is free of outwardly protruding edges.

6. The ballistic vest carrier as in claim 1, wherein the upper outer carrier panel and the lower outer carrier panel are made of woven nylon.

7. The ballistic vest carrier as in claim 1, configured to accept a ballistic panel having a width between 41 cm and 48.5 cm and a height between 40 cm and 43.5 cm.

8. The ballistic vest carrier as in claim 1, wherein the pocket is configured to accept a ballistic plate having a width between 25 and 30 cm and a height between 25 and 35 cm.

9. A ballistic vest, comprising a first ballistic vest carrier as in claim 1 and a second ballistic vest carrier as in claim 1, wherein the first ballistic vest carrier and the second ballistic vest carrier are held together by shoulder straps and side straps.

10. A ballistic vest, comprising a front carrier, a rear carrier, shoulder straps connecting an upper portion of the front carrier with an upper portion of the rear carrier, and side straps connecting left and right side portions of the front carrier with respective left and right side portion of the rear carrier, wherein the front carrier and the rear carrier each comprise:

an outer face and an inner face made of fabric panels connected by a seam along an entire outer perimeter of the carrier, the outer face being formed by a lower outer carrier panel and an overlapping upper outer carrier panel, and the inner face being formed by a lower inner carrier panel and an overlapping upper inner carrier panel;

a ballistic panel held within the carrier between the outer face and the inner face; and a pocket adapted to accept a ballistic plate, the pocket being arranged on a strike side of the ballistic panel and being accessible through the overlap of the lower and upper outer carrier panels.

11. The ballistic vest as in claim 10, wherein the front carrier and the rear carrier each comprise a hook and loop fastener to releasably connect the respective lower outer carrier panel and the respective upper outer carrier panel along a center portion of their overlap, and wherein the respective lower outer carrier panel and the respective upper outer carrier panel are sewn together along peripheral portions of their overlap.

12. The ballistic vest as in claim 11, wherein the front carrier and the rear carrier each have an upper portion of the respective lower outer carrier panel which has a trapezoidal shape in an area of the respective hook and loop fastener.

13. The ballistic vest as in claim 10, wherein the seam along the outer perimeter of each the front carrier and the rear carrier connects the respective lower inner carrier panel to the respective lower outer carrier panel, the respective upper inner carrier panel to the respective lower outer carrier panel, and the respective upper inner carrier panel to the respective upper outer carrier panel.

14. The ballistic vest as in claim 10, wherein a the pocket of each the front carrier and the rear carrier is at least partially formed by a portion of the respective upper outer carrier panel which is arranged on an inside of the respective lower outer carrier panel below an upper edge of the respective lower outer carrier panel.

15. The ballistic vest as in claim 10, wherein a portion of the respective upper outer carrier panel of each the front carrier and the rear carrier which is arranged below an upper edge of the respective lower outer carrier panel and forms an inner wall of the respective pocket.

16. The ballistic vest as in claim 10, wherein the outer face and the inner face of the front carrier are congruent, and wherein the outer face and the inner face of the rear carrier are congruent.

* * * * *